US010301755B2

(12) United States Patent
Plack

(10) Patent No.: US 10,301,755 B2
(45) Date of Patent: May 28, 2019

(54) WET TREATMENT DEVICES, IN PARTICULAR DYEING CENTRIFUGES, AND A METHOD FOR OPERATING SUCH A DYEING CENTRIFUGE

(71) Applicant: Ludwig Plack, Biedenkopf (DE)

(72) Inventor: Ludwig Plack, Biedenkopf (DE)

(73) Assignee: Industriefärberei, Faserveredlung und Faserausrüstung Wilhelm Plack, Inhaber: Ludwig Plack e.K., Biedenkopf (DE)

( * ) Notice: Subject to any disclaimer, the term of this patent is extended or adjusted under 35 U.S.C. 154(b) by 0 days.

(21) Appl. No.: 14/915,450

(22) PCT Filed: Jul. 3, 2014

(86) PCT No.: PCT/EP2014/064240
§ 371 (c)(1),
(2) Date: Feb. 29, 2016

(87) PCT Pub. No.: WO2015/028176
PCT Pub. Date: Mar. 5, 2015

(65) Prior Publication Data

US 2016/0208424 A1 Jul. 21, 2016

(30) Foreign Application Priority Data

Aug. 30, 2013 (DE) ..... 10 2013 109 482

(51) Int. Cl.
*D06B 5/26* (2006.01)
*D06F 39/08* (2006.01)

(52) U.S. Cl.
CPC ..... *D06B 5/26* (2013.01); *D06F 39/083* (2013.01); *D06F 2204/082* (2013.01)

(58) Field of Classification Search
CPC .... D06F 39/083; D06F 2204/082; D06B 5/26
(Continued)

(56) References Cited

U.S. PATENT DOCUMENTS 4,637,230 A * 1/1987 Roberts ..... D06F 29/00 68/18 FA
4,809,524 A * 3/1989 Sickert ..... D06F 37/145 68/148

(Continued)

FOREIGN PATENT DOCUMENTS

CN 101413195 A * 4/2009
DE 3934406 A1 4/1991

(Continued)

OTHER PUBLICATIONS

Certified German Patent Application No. 10 2013 109 482.1 filed on Aug. 30, 2013.

(Continued)

*Primary Examiner* — Michael E Barr
*Assistant Examiner* — Kevin G Lee
(74) *Attorney, Agent, or Firm* — Conley Rose, P.C.; Keith C. Rawlins

(57) ABSTRACT

A wet treatment device (1) for the wet treatment of textile making-ups (T) has a treatment drum (10) which is driven about a vertical axis of rotation (A) in a direction of rotation (V) by a rotary drive. The treatment drum (10), which can be loaded at the top, has a drum shell (13) arranged on the circumferential side relative to the axis of rotation (A) and having an outlet opening (20). The latter opens into a return line device (30) which is arranged to be fixed against rotation and which has an annular channel (32) enclosing the treatment drum (10) radially and formed so as to be open in the direction of the outlet opening (20). In addition, the return line device (30) has a discharge opening (31), which is positioned above the drum base (11) and closer to the axis of rotation (A) than the first outlet opening (20). A rotating treatment drum arranged within a pressure vessel is also disclosed, as well as a method for the wet treatment of textile making-ups in a treatment drum, in which the liquor is led (Continued)

back into the center of the treatment from by a return line without using any drive.

22 Claims, 7 Drawing Sheets

(58) Field of Classification Search
USPC ..... 68/12.19, 148
See application file for complete search history.

(56) References Cited

U.S. PATENT DOCUMENTS

| | | | | |
|---|---|---|---|---|
| 6,351,974 | B1 * | 3/2002 | Lyu | D06F 35/006 68/148 |
| 9,010,159 | B2 * | 4/2015 | Sharp | D06F 23/04 68/142 |
| 2002/0116960 | A1 * | 8/2002 | Nakada | D06F 25/00 68/18 F |
| 2013/0180292 | A1 * | 7/2013 | Obregon | D06F 7/02 68/134 |

FOREIGN PATENT DOCUMENTS

| | | | | |
|---|---|---|---|---|
| DE | 19800735 | C1 | 7/1999 | |
| FR | 1164672 | A | 10/1958 | |
| FR | 2177237 | A5 | 11/1973 | |
| GB | 581391 | | 10/1946 | |
| GB | 854221 | | 11/1960 | |
| WO | WO 9935319 | A1 * | 7/1999 | D06B 5/26 |
| WO | 2015028176 | A1 | 3/2015 | |

OTHER PUBLICATIONS

Foreign communication from a related counterpart application—International Search Report and Written Opinion, English translation, PCT/EP20141064240, dated Jan. 9, 2015, 14 pages.
Foreign communication from a related counterpart application—International Preliminary Report on Patentability, English translation, PCT/EP2014/064240, dated Mar. 1, 2016, 12 pages.
First Office Action of Chinese Application No. 2014800587818 dated Feb. 23, 2017, with English translation, 14 pages.
Foreign communication from a related application- Notification of Reasons for Refusal of Japanese Patent Application No. 2016-537171, dated Jul. 24, 2018, with English translation, 4 pages.

* cited by examiner

WET TREATMENT DEVICES, IN PARTICULAR DYEING CENTRIFUGES, AND A METHOD FOR OPERATING SUCH A DYEING CENTRIFUGE

CROSS-REFERENCE TO RELATED APPLICATIONS

This application is a filing under 35 U.S.C. 371 of International Application No. PCT/EP2014/064240 filed Jul. 3, 2014, entitled "Wet Treatment Devices, in Particular Dyeing Centrifuges, and a Method for Operating such a Dyeing Centrifuge," which claims priority to German Patent Application No. 10 2013 109 482.1 filed Aug. 30, 2013, which applications are incorporated by reference herein in their entirety.

FIELD OF INVENTION

The invention relates to wet treatment devices, in particular dyeing centrifuges, for the wet treatment of textile make-ups of all types, in particular for the dyeing and decolorizing of the textile make-ups using a fluid treatment agent, the so-called liquor, and to a method for operating such a wet treatment device.

BACKGROUND

Various wet treatment devices for the dyeing of textile make-ups using liquor are known from the prior art. Textile make-ups include flock and other embodiments, for example fabrics, knitted fabrics, woven fabrics, threads, yarns and twine.

Wet treatment devices exist which are composed substantially of a boiler-like vessel and of a cylinder drum standing upright therein. The cylinder drum has a drum base at the bottom, has a drum opening at the top, and has a drum shell which is perforated in the manner of a sieve. The diameter of the drum shell is slightly smaller than the clear width of the vessel. Furthermore, within the cylinder drum, there is inserted a core cylinder which is perforated in the manner of a sieve and the diameter of which is considerably smaller than that of the drum shell. Tamped material for dyeing (flock) is introduced into the space between the core cylinder and the drum shell, said material having a density of approximately 300 to 400 grams of material for dyeing per liter of space filled. The cylinder drum is closed off before the dyeing process by way of a drum cover.

A pump arranged on the vessel base drives a liquor that is introduced into the vessel into the core cylinder. Subsequently, the liquor flows substantially horizontally through the wall of the core cylinder, through the material for dyeing and through the drum shell. Thereafter, said liquor flows downward between the drum shell and a vessel wall. The pump is situated on the housing base, which pump conveys the liquor into the core cylinder again. Pump-assisted circulation of the liquor is realized. For the removal of excess dye, the material for dyeing is subsequently treated by rinsing and drying, in part in separate devices. This is cumbersome. A further disadvantage is the compaction of the textile fibers, which must be loosened again in cumbersome fashion.

DE 198 00 735 A1 describes a centrifuge-like device for the wet treatment of textile material in a double-walled treatment drum. The treatment drum is closed off by way of a hinged cover which has an aperture in the central region. In the shell of the treatment drum there is provided at least one outlet opening. A liquor is introduced by a delivery pump into the center of the treatment drum from above. As a result of rotation of the treatment drum about an axis of rotation, the liquor is accelerated outward and, after passing through the textile fibers, emerges from the treatment drum through an outlet opening. The drum is arranged within a housing which captures and collects the emerging liquor, before said liquor is pumped back into the treatment drum again by way of the pump. In order that the liquor can be introduced uniformly over the entire height, a core drum which is not filled with textile fibers is arranged in the center of the treatment drum, said core drum having a sieve-like core shell. The core drum is referred to in DE 198 00 735 A1 as liquor distributor.

A disadvantage of these devices is that they are relatively expensive, the equipping process requires great expenditure of work, the process times are long, and the amount of energy that has to be expended is high. A further disadvantage of the known devices as described above consists in that a very large amount of liquor is required per unit amount of material for dyeing. The heating of said liquor requires a large amount of energy. Furthermore, the pump can become blocked by discharged textile fibers. After one dyeing process, it may also be the case that, in a further dyeing process, the flock becomes contaminated with fibers of the old flock that have remained in the pump system. A further disadvantage is the poor color penetration through different fibers, which cannot be compensated even by way of long process times with liquor circulation.

SUMMARY OF INVENTION

The invention is based on the object of providing a wet treatment device for the dyeing of textile make-ups of all types, which wet treatment device does not have the disadvantage as described above. The device should be greatly simplified, and the expenditure of work, amount of liquor and amount of energy required for a treatment process should be reduced. Finally, the cleaning effort and the risk of pump failure owing to discharged textile fibers should be reduced. It is also sought to realize a more simple, safe and reliable operating method with good color penetration.

The main features of the invention are specified in the characterizing parts of claims 1 and 16 and in claim 18. The dependent claims relate to refinements.

The invention relates to a wet treatment device for the wet treatment of textile make-ups, which include in particular flocks and other embodiments, such as for example fabrics, knitted fabrics, woven fabrics, threads, yarns and twine, in particular for the dyeing and decolorizing of the textile make-ups using a liquor. For this purpose, the wet treatment device has a treatment drum which is driven in a direction of rotation about a (geodetically) vertical axis of rotation by a rotary drive, wherein the treatment drum has a closed drum base (the drum base being closed at least during operation), a drum opening on a top side, and a drum shell which is arranged at the circumference relative to the axis of rotation and which has at least one first outlet opening. Here, the wet treatment device according to the invention is characterized in that the first outlet opening issues into a rotationally fixedly arranged recirculation line device, wherein the recirculation line device has a ring-shaped duct which radially encompasses the treatment drum and which is formed so as to be open in the direction of the first outlet opening, that is to say at the inside. Furthermore, the recirculation line device has an outflow opening which is positioned above the drum base and closer than the first outlet opening to the axis of rotation.

An advantage of an embodiment of said type is that the amount of (electrical) energy required for the drive action and for heating the liquor is low, and a short process duration is realized. This is achieved inter alia in that, according to the invention, a permanent circulation of the liquor can be realized without the use of an additional pump. Specifically, the outwardly directed speed of the liquor is diverted in the direction of the axis of rotation by way of the recirculation line device. A specific embodiment of the invention therefore explicitly provides that the recirculation line device is of pump-free design. In other words, the recirculation of the liquor via the recirculation line device is effected (exclusively) by the rotation of the treatment drum, preferably by virtue of the recirculation line device conducting the liquor through the drum opening and back into the treatment drum.

Furthermore, according to the invention, the amount of liquor required is low because only a small amount of liquor is bound in the recirculation line device. Specifically, no collecting vessels and pump circuits are required in order to realize the circulation circuit. It is thus possible to achieve a 50% saving in terms of the amount of liquor, whereby the energy required for heating the liquor is likewise reduced by 50%. This is ecologically and economically expedient. Furthermore, a liquor build-up that occurs advantageously takes place in the radial direction on the drum shell, which prevents a compaction of the textile fibers.

Furthermore, owing to the centrifuge-like design, the wet treatment device is also suitable for the processes of rinsing and dewatering by centrifuging of the textile make-ups, such that working steps can be combined. Correspondingly, the total treatment time of the fibers is short. By way of the centrifuging, the liquor can be discharged before the rinsing process, whereby only a small amount of rinsing water, or small rinsing baths, is or are required. Thus, all fluid treatment agents are suitable as liquor, for example colorizing, decolorizing and rinsing liquids such as water.

In order that the ring-shaped duct is formed so as to be open toward the outlet opening in all rotational positions of the treatment drum, the opening of the ring-shaped duct should be in the form of an encircling slot at the inner side, that is to say in the direction of the drum shell. Said slot may however be interrupted at a transition of the ring-shaped duct into a riser section.

A further advantage can be attained by way of an outer housing which can be of compact design, whereby less operating space is required. At the same time, with a housing of said type, a high level of thermal insulation can be achieved. Thus, only low heat losses occur, and the climate control of the surrounding personnel working area constitutes less of a problem.

The device according to the invention may for example be designed, in practice, for a batch size of 50-120 kg of textile fibers. Such a device would then operate in a rotational speed range of approximately 0-1400 rpm of the treatment drum. In the case of such a structural size, the flow duct diameter of the ring-shaped duct may then be approximately 5 cm.

In order that a maximum amount of liquor can be conducted back into the center of the treatment drum by way of the recirculation line device, the treatment drum may be formed so as to be sealed with respect to the ring-shaped duct. This however gives rise to friction and thus undesired energy losses. A further problem in this context is the imbalance of the treatment drum. It is therefore preferable for the ring-shaped duct to surround the treatment drum in contactless fashion, in particular with a minimum gap. For this purpose, it is necessary in each case that the ring-shaped duct has a circular internal diameter and the treatment drum has a circular external diameter (in each case relative to the axis of rotation) in the region of the ring-shaped duct. It is furthermore necessary for the central axis of the treatment drum to be arranged coaxially with respect to the axis of rotation, and for the central axis of the ring-shaped duct to also exhibit said coaxiality. In practice, owing to the drum imbalance, minimum gaps of 10 mm to 20 mm are normally necessary. This is not critical because the liquor, owing to its speed, rotates on the outer radius of the ring-shaped duct (the duct base), such that only small losses occur through the ring-shaped gap, for example as a result of splashing and foaming. The ring-shaped duct is consequently not completely filled with liquor during operation.

Thus, a small amount of liquor is discharged from the circulation circuit through the minimum gap. It is however often necessary in any case for certain contents of the liquor to be adjusted and replaced during the dyeing process. It is possible for the discharged liquor to be analyzed and for the liquor to be recirculated in enriched form or replaced. A pump required for this purpose may be designed to be relatively small owing to the small delivery rate. The minimum gap and ring-shaped duct are preferably designed such that at most 10%, preferably 5% to 10%, of the liquor can escape from the circuit through them. In this way, a high level of energy efficiency, including the energy used per unit amount of textile treated, is achieved.

According to a more specific refinement of the invention, at least one second outlet opening is formed in the drum shell, wherein each outlet opening issues into the ring-shaped duct of the recirculation line device. The amount of liquor flowing out can be predefined by way of the number of outlet openings. The greater the number of outlet openings that are distributed over the circumference of the drum shell, the greater the amount that flows out. At the same time, the ring-shaped duct can be formed with a relatively compact cross section, preferably with a substantially circular to U-shaped internal diameter, if the outlet openings are arranged at the same height of the drum shell. To achieve uniform color penetration, the outlet openings should be arranged in evenly distributed fashion over the circumference of the drum shell.

A further development of the invention provides that each outlet opening is in the form of a nozzle, wherein the outflow direction of the nozzle has an angle of inclination in the direction of rotation. In this way, the liquor is accelerated through the nozzle in the direction of rotation. The kinetic energy that the liquor thus has in the ring-shaped duct can subsequently be utilized for overcoming a height difference.

In a special development of the invention, the angle of inclination is between 40° and 50°, preferably between 42° and 48°, and is particularly preferably 45°, in particular relative to the running direction of the nozzle along the circular path. A nozzle may be formed by way of the insertion of a small tube into a bore in the drum shell. In practice, a small tube of said type is for example 10 mm long. The cross section preferably tapers. Foaming of the liquor is thus reduced.

Furthermore, in a development of the invention, the recirculation line device comprises a riser section which bridges a height difference in the longitudinal direction of the axis of rotation between the ring-shaped duct and the drum opening and which leads beyond the drum opening. With a riser section of said type, it is now possible for the liquor to be conducted back into the center of the drum again from above through the drum opening. The riser section preferably opens out of the ring-shaped duct in an upward direction. The diameter is then particularly small. The housing can be correspondingly compact. The transition from the ring-shaped duct to the riser section may be in the form of a ramp or in the form of a tubular interruption piece of the ring-shaped duct. An interruption should be as small as possible in order to avoid liquor losses; this relates in particular to the closed surface in the direction of the outlet opening. Alternatively, a radially opening-out configuration is possible, preferably then by way of an outer radius or base of the ring-shaped duct which widens in spiral fashion. It is basically possible for the riser section to be led out of the housing, for example via a housing cover. It is however preferable for the entire recirculation line device to be situated within the housing, whereby the latter can be formed, in uncomplicated fashion, as a pressure vessel.

In a special variant of the invention, the riser section winds in the direction of rotation about the axis of rotation from the direction of the ring-shaped duct in the direction of the outflow opening (of the recirculation line device). It is thus possible for the kinetic energy of the rotating liquor to be converted in an efficient manner into potential energy; in other words, the liquor rises up the riser section.

The flow cross section of the riser section preferably amounts to between 90% and 110% of the flow cross section of the ring-shaped duct. The flow resistance in the riser section thus substantially corresponds to that of the ring-shaped duct, and the rising of the liquor in the riser section is scarcely impeded. Particularly good rising performance is achieved in practice with a maximum gradient of the riser section of 10% to 20%, preferably 12% to 18%, and particularly preferably 14% to 16%.

For further improvement of the throughflow rate through the recirculation line device, a development is particularly suitable in which the flow cross section downstream of the riser section narrows in the direction of the outflow opening, preferably by 45% to 55%, and particularly preferably by 47% to 53%. Here, the line is then completely filled during operation, and a suction effect can be generated.

Furthermore, according to a further specific embodiment, the recirculation line device comprises a winding section which winds around the axis of rotation and which, from the direction of the ring-shaped duct, approaches the axis of rotation in the direction of the outflow opening (of the recirculation line device) and in the direction of rotation. The flowing liquor is thus diverted in the direction of the center of the treatment drum.

In a further optional embodiment, the recirculation line device has a falling section which adjoins the outflow opening (of the recirculation line device) and which falls vertically, and which is in particular preferably oriented substantially in the longitudinal direction of the axis of rotation. A falling section of said type is suitable for recirculating the liquor in targeted fashion. Furthermore, a suction effect can be generated, whereby the overcoming of the height difference, and thus the throughflow rate of the liquor, are improved. For this purpose, the outflow opening should ideally be arranged at the level of the outlet opening or below the latter, that is to say, for this purpose, the falling section projects into the treatment drum through the drum opening. The suction action can be utilized optimally if the falling section is oriented vertically at least in sections, particularly preferably in the region of the outlet opening.

The recirculation line device thus preferably comprises a riser section which, at the inlet side, adjoins the ring-shaped duct and, at the outlet side, adjoins a winding section. The winding section is in turn then adjoined by a falling section. Here, the sections may in each case overlap. For example, the riser section may simultaneously be formed as a winding section, and/or the winding section itself may fall and be part of the falling section.

Furthermore, one refinement of the invention provides that each outlet opening is arranged in the upper third, preferably in the upper fifth, and particularly preferably in the upper tenth, or at the upper end, of the drum shell, that is to say closer to the drum opening than to the drum base. Correspondingly, the height difference that must be overcome by the recirculation line device is small, because the part of the height from the drum base to the outlet opening is bridged by the centrifugal force and by the liquor that collects on the inner side of the drum shell.

One variant of the invention is supplemented by a core drum which is arranged in the treatment drum so as to be oriented coaxially with respect to the axis of rotation, wherein the core drum has a core drum opening on a top side and has a sieve-like core drum shell and extends as far as the drum base. A core drum of said type may also be referred to as a distributor for the liquor. Here, the liquor can pass unhindered to the drum base and is centrifuged against the core drum shell as a result of the rotation of the core drum (the latter should be connected rotationally conjointly to the treatment drum). Said liquor is hereby distributed over the height of the core drum shell, and can be introduced into the textile make-ups through the sieve holes in a relatively uniformly distributed manner over the height (if the centrifugal forces are considerably greater than gravitational acceleration). In order that said textile make-ups can be introduced between the core drum and the drum shell, the diameter of the core drum shell should be (considerably) smaller than the diameter of the drum shell, in particular by at least a factor of 3. A further advantage can be achieved if either a fine-mesh additional sieve is used, or the sieve meshes of the core cylinder are of fine form. It is then specifically the case that foreign fibers that have remained somewhere in the device from preceding production cycles can be retained. The quality of the treated fibers thus remains high.

The core drum may for example be in the form of a cylinder which is fastened to the drum base of the treatment drum and which is composed of a sieve plate. This is however not imperatively necessary; rather, a rotationally conjoint arrangement of the core drum during operation is sufficient. It is thus possible for exchangeable, different core drums to be utilized for different liquors and/or textile make-ups and/or batches. It is furthermore possible for the core drum to be part of an insert for receiving the textile make-ups. Such an insert is in any case preferably inserted so as to be rotationally conjoint with respect to the treatment drum.

In order that the liquor flowing via the recirculation line device passes into the core drum, it is provided, in a more specific refinement of the invention, that the outflow opening of the recirculation line device is arranged closer than the core drum shell to the axis of rotation.

Furthermore, an optional addition to the invention consists in that the recirculation line device has a heating section. The liquor must often be temperature-controlled, which can be achieved by way of a heating section of said type in the non-rotating region of the wet treatment device. This is uncomplicated and inexpensive.

A special variant provides that the heating section has a heating duct for conducting a fluid heating medium, which heating duct adjoins a duct for conducting the liquor (the recirculation line device). It is then possible for heated liquid or gas as heating medium to be conducted through a duct of said type, which heating medium can transmit the thermal energy to the liquor. Owing to small temperature differences in the case of heat exchangers of said type, chemical changes to the liquor, for example as a result of partial boiling, or sedimentation in the liquor are prevented.

Here, the ring-shaped duct is preferably arranged adjacent to the heating duct. For this purpose, the heating duct may radially surround the treatment drum in ring-shaped fashion. At the same time, the ring-shaped duct may be arranged at least partially within the heating duct. Only the inlet opening, situated opposite the outlet openings, of the ring-shaped duct must remain free.

Furthermore, in a further development of the invention, a spaced-apart sieve wall is positioned in front of the drum shell (of the treatment drum), for example with a spacing of 2 cm. It is thus possible for the liquor to flow horizontally through the textile make-ups and to subsequently freely form a layer vertically along the drum shell. Uniform treatment, for example uniform dyeing, of the textile make-ups is achieved in this way. The sieve wall positioned in front need not be fixedly connected to the treatment drum. Rather, said sieve wall may also be part of an insert for receiving the textile make-ups.

Furthermore, in a further development, the wet treatment device is refined such that the treatment drum and the recirculation line device are arranged within a housing which collects discharged liquor. This is expedient in particular if the ring-shaped duct is formed so as to be contact-free with respect to the drum shell, because then, a part of the liquor passes to the outside through the gap. Furthermore, the housing serves to realize a high level of industrial safety. For reuse of the collected liquor, a pump is preferably provided for delivering the liquor that has been collected by the housing back into the treatment drum. The collected liquor may also undergo treatment, be supplemented or be replaced.

The housing is preferably in the form of a thermal insulation. Correspondingly, little thermal energy escapes, and the efficiency of the wet treatment is high. Furthermore, the housing is preferably in the form of a pressure vessel. For this purpose, the pressure vessel should withstand an (operating) internal pressure in the pressure chamber of at least 1.5 bar, preferably 3 bar. Consequently, the liquor can be heated beyond its atmospheric boiling point and remains liquid. The wet treatment device is thus suitable for high temperatures.

In a further version of the invention, the drum opening is closed off by way of a drum cover, in particular in fluid-tight fashion in the sealing zone, that is to say there is then a radially encircling seal along the drum shell. This thus prevents a situation in which, at high rotational speeds, liquor can flow out through the drum opening or splash over the shell edge thereof. For the recirculation line device, the drum cover preferably has a central opening, that is to say an opening arranged in the region of the axis of rotation. In order that the drum cover can be removed, that part of the recirculation line device which is situated above the drum opening should be mobile, that is to say either detachable/removable or flexible.

To improve the efficiency of the wet treatment, there is the option for the rotary drive to have a generator mode by which electricity can be generated during a decrease in rotational speed of the treatment drum. It is thus also possible to dispense with mechanical brakes, and/or to shorten unproductive run-down times.

In a more specific refinement, the recirculation line device has an openable outlet opening radially outside the treatment drum. The liquor can be drained through said outlet opening at the end of a treatment process. Here, a flap or a valve may be arranged on the outlet opening. Furthermore, an enhancement is expedient in which one of the further line sections, specifically the riser section, winding section or falling section, has a closure element. The liquor then flows out more quickly. The closure element is preferably designed such that, in a first position, it blocks the outlet opening, and in a second position, it blocks the riser line.

The invention also relates to a method for operating a wet treatment device as described above, in which a textile make-up and liquor are introduced into the treatment drum, and the treatment drum is rotated in a direction of rotation, wherein, owing to a resultant centrifugal force, the liquor is accelerated from the center of the treatment drum in the direction of the drum shell, flows through the first outlet opening into the ring-shaped duct of the recirculation line device, and, by way of the recirculation line device, is at least partially recirculated, preferably is at least 85% recirculated, without the use of a drive (i.e. without an additional pump), into the treatment drum again at a position closer to the axis of rotation via the outflow opening of the recirculation line device.

With this method, little (electrical) energy is required for the drive action and for heating the liquor, and a short process duration is achieved. The further advantages that have been described with regard to the wet treatment device can also be realized. The rotational speed during operation is preferably selected to be between 10 rpm and 1400 rpm; in particular, approximately 220 rpm is very highly suited to a dyeing process, and approximately 600 rpm to 1400 rpm is suitable for centrifuging and rinsing. By way of the centrifuging, it is possible to achieve a rinsing water saving of up to 70%. Furthermore, the fiber compaction is low.

The invention also relates to a wet treatment device for the wet treatment of textile make-ups, in particular for the dyeing and decolorizing of the textile make-ups using a liquor, having a treatment drum which is driven in a direction of rotation about a vertical axis of rotation by a rotary drive, wherein the treatment drum has a closed drum base, a drum opening on a top side, and a drum shell which is arranged at the circumference relative to the axis of rotation and which has at least one first outlet opening, wherein the treatment drum is arranged within a housing which is in the form of a pressure vessel with a pressure chamber, and wherein the treatment drum is arranged within the pressure chamber.

By way of the circulation of the treatment drum, the liquor again flows radially outward through the material for dyeing, without this having to be effected by way of a pump pressure. Uniform color penetration is achieved with little expenditure of energy. The wet treatment device according to the invention also permits, by way of its pressure vessel, dyeing processes at temperatures above the atmospheric boiling point, that is to say the wet treatment device is suitable for high temperatures. This permits completely novel approaches to fiber finishing. In practice, it has been found that the pressure vessel should, for this purpose, withstand an (operating) internal pressure in the pressure chamber of at least 1.5 bar, preferably 3 bar.

The treatment drum provided here may also have a core drum oriented coaxially with respect to the axis of rotation, which core drum in turn has a core drum opening on a top side and has a sieve-like core drum shell and extends as far as the drum base. In this way, the liquor is introduced into the textile make-up in a particularly uniform manner and, furthermore, discharged fibers are retained. Uniform color penetration and a high level of varietal purity of the textile make-up are thus achieved. Furthermore, it is also possible here for a recirculation line device as described above to be provided.

BRIEF DESCRIPTION OF THE DRAWINGS

Further features, details and advantages of the invention will emerge from the wording of the claims and from the following description of exemplary embodiments on the basis of the drawings, in which:

DETAILED DESCRIPTION OF THE DRAWINGS

Figure 1:
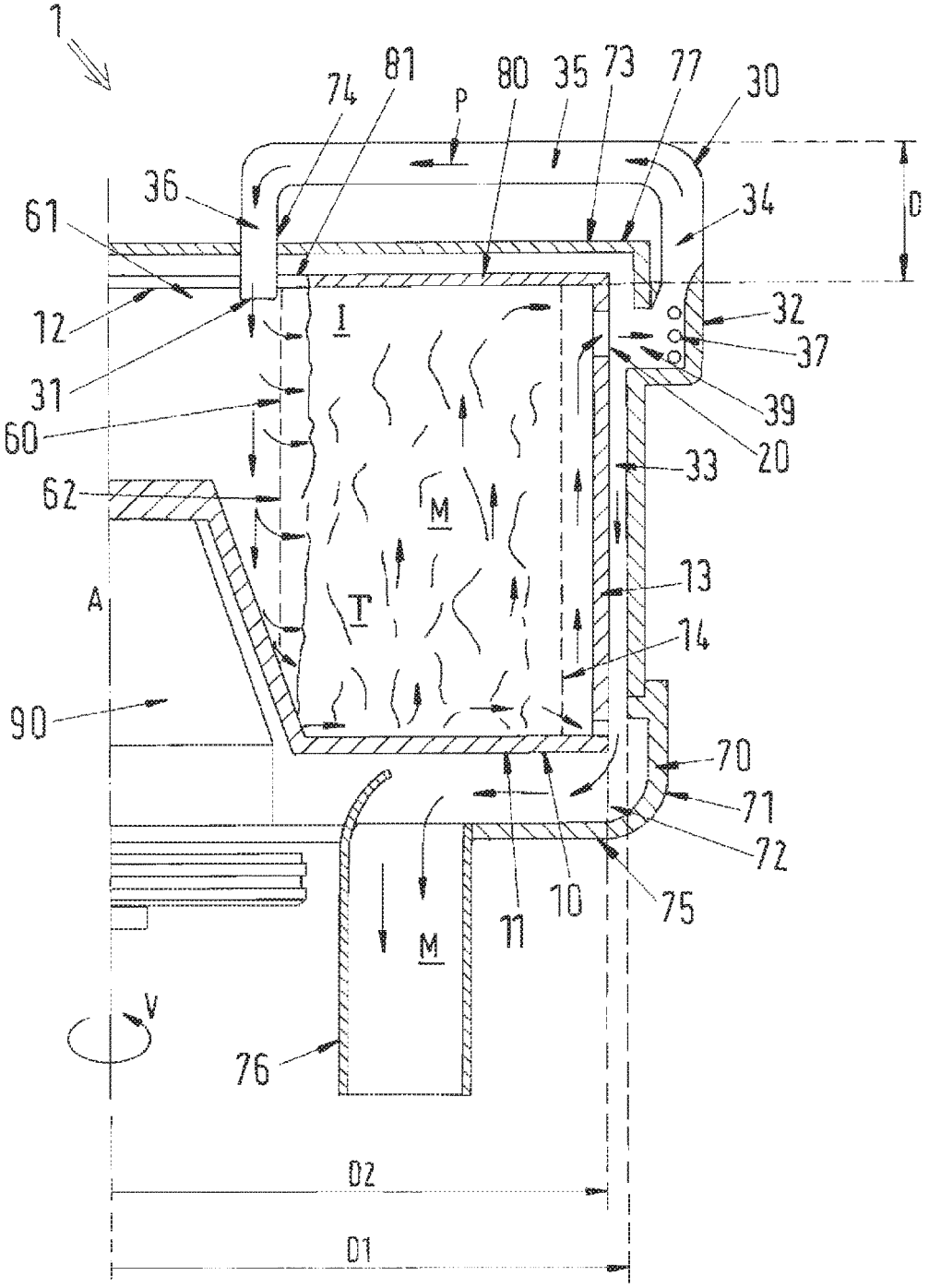
FIG. 1 shows a vertical section through a sketched wet treatment device.

FIG. 1 shows a vertical section through a sketched wet treatment device 1 for the wet treatment of textile make-ups T, in particular for the dyeing and decolorizing of the textile make-ups T using a liquor M, for example using colorizing or decolorizing liquor and rinsing baths. The wet treatment device 1 is suitable for flock and other embodiments, for example fabrics, knitted fabrics, woven fabrics, threads, yarns and twine. Many of the features in FIG. 1 can also be seen in FIGS. 2 to 7.

In the illustration of FIG. 1, it is possible to see, at the outer side, a drum-like housing 70 which is rotationally fixed. Said housing functions as a protective device and a thermal insulation, the latter in particular also by way of its design as a pressure vessel 71. By way of the pressure vessel, the liquor M can be heated to above its atmospheric boiling point without changing into the gaseous phase. A drain pipe 76 opens out at the housing base 75. A housing opening 77 on a top side is closed off by way of a housing cover 73. Within the housing 70 there is thus formed a pressure chamber 72 in which an internal pressure I prevails.

Within the housing 70, in particular within the pressure chamber 72, there is rotatably mounted a treatment drum 10 which is in particular driven in a direction of rotation V about a vertical axis of rotation A by a rotary drive 90. Here, the central axis of the treatment drum 10 is arranged coaxially with respect to the axis of rotation A. The treatment drum 10 has a closed drum base 11, a drum opening 12 on a top side, and a drum shell 13 which is arranged circumferentially relative to the axis of rotation A and which is of substantially cylindrical form. A sieve wall 14 is positioned in front of the drum shell 13 at the inner side. The drum opening 12 on the top side is closed off by way of a drum cover 80, which has a central opening 81.

In the drum shell 13 there is formed a first outlet opening 20. Said first outlet opening is, in the direction of the axis of rotation A, situated in the upper sixth, and thus at the upper end, of the drum shell 13, and consequently also closer to the drum opening 12 than to the drum base 11.

It is possible to see, in the center of the treatment drum 10, a core drum 60 which is oriented coaxially with respect to the axis of rotation A. Said core drum has a core drum opening 61 on a top side and has a sieve-like core drum shell 62 which extends as far as the drum base 11. The diameter of the core drum shell 62 is considerably smaller, in this case by more than a factor of 3, than the diameter of the drum shell 13. In particular, the core drum 60 is in the form of a cylinder composed of a sieve plate which is fastened to the drum base 11 of the treatment drum 10.

The outlet opening 20 opens into a rotationally fixedly arranged recirculation line device 30. The recirculation line device 30 is formed partially integrally with the housing 70 and is thus connected rotationally fixedly and axially fixedly thereto. For the opening-in of the outlet opening 20, the recirculation line device 30 has a ring-shaped duct 32 which radially surrounds the treatment drum 10 and which is formed so as to be open in the direction of the first outlet opening 20, in particular by way of a ring-shaped duct slot 39 at the inner side. Here, a minimum gap 33 remains between the treatment drum 10 and the ring-shaped duct 32. Approximately 10% of the liquor M escapes through the minimum gap 33 during operation. In order that said minimum gap 33 is maintained in all rotational positions of the treatment drum 10, the ring-shaped duct 32 has a circular internal diameter D1, and the treatment drum 10 has a circular external diameter D2 relative to the axis of rotation A in the region of the ring-shaped duct 32. The discharged liquor M can be collected by way of the housing 70. Depending on requirements, said liquor may then be conveyed back into the treatment drum 10 by way of a small pump, or else initially enriched and then conveyed back, or replaced.

The recirculation line device 30 is of entirely pump-free design. Its mode of operation is based on a recirculation of the liquor M by way of the rotation of the treatment drum 10, which likewise sets the liquor M in rotation. In this way, the liquor M has kinetic energy. It can be seen that the recirculation line device 30 conducts the liquor M through the drum opening 12 back into the treatment drum 10. For this purpose, the ring-shaped duct 32 is adjoined by tubular line sections, specifically firstly a riser section 34, which opens out from the ring-shaped duct 32 on the top side, subsequently a winding section 35, and finally a falling section 36, which forms an outflow opening 31.

The riser section 34 that opens out from the ring-shaped duct 32 overcomes a height difference D in the longitudinal direction of the axis of rotation A between the ring-shaped duct 32 and the drum opening 12. The riser section 34 leads beyond the drum opening 12 and also beyond the housing cover 73, such that the recirculation line device 30 can be led in the direction of the axis of rotation A from the outside across the drum wall 13. Here, the riser section 34 winds in the direction of rotation V about the axis of rotation A from the direction of the ring-shaped duct 32 in the direction of the outflow opening 31. The flow cross section of the riser section 34 amounts to between 90% and 110% of that of the ring-shaped duct 32. Furthermore, the maximum gradient of the riser section 34 is approximately 15%.

The riser section 34 is adjoined by the substantially horizontally running winding section 35. Said winding section winds in the direction of rotation V about the axis of rotation A from the direction of the ring-shaped duct 32 in the direction of the outflow opening 31, wherein said winding section approaches said axis of rotation. Here, the winding forms a tightening curve, specifically similar to a logarithmic spiral.

The winding section 35 is followed by the falling section 36, which diverts the flow direction of the liquor M into the vertical, specifically substantially downward in the direction of the axis of rotation A. The falling section 36 is led firstly through a housing cover leadthrough 74 of the housing cover 73. The falling section 36 and housing cover 73 are in this case of pressure-tight design. Subsequently, the falling section 36 projects through the central opening 81 in the drum cover 80, and ends at the outflow opening 31, which points downward. Thus, the outflow opening 31 is positioned above the drum base 11 and closer than the outlet opening 20 to the axis of rotation A. In particular, the outflow opening 31 of the recirculation line device 30 is also arranged closer than the core drum shell 62 to the axis of rotation A, such that the liquor M passes back into the core drum 60. Here, the outflow opening 31 is situated approximately at the level of the outlet opening 20. When the falling section 36 is filled, it is thus basically possible to realize a suction action.

Furthermore, it is possible to see a heating section 37 of the recirculation line device 30. Said heating section comprises a heating register situated within the ring-shaped duct 32.

It is thus now possible for textile make-ups T and liquor M to be introduced into the treatment drum 10 and for the treatment drum 10 to be rotated about the axis of rotation A. By way of a resultant centrifugal force, the liquor M is then accelerated from the center of the treatment drum 10 in the direction of the drum shell 13. Here, said liquor collects on the inner side of the drum shell 13 and passes through the outlet opening 20 into the ring-shaped duct 32. In practice, 10% of the liquor then flows outward through the minimum gap 33 into the housing 70. The remaining 90% is, by way of the recirculation line device 30, conducted back, without the use of a drive, i.e. without an additional pump, into the treatment drum 10 again at a position closer to the axis of rotation A via the outflow opening 31 of the recirculation line device 30.

Figure 2:
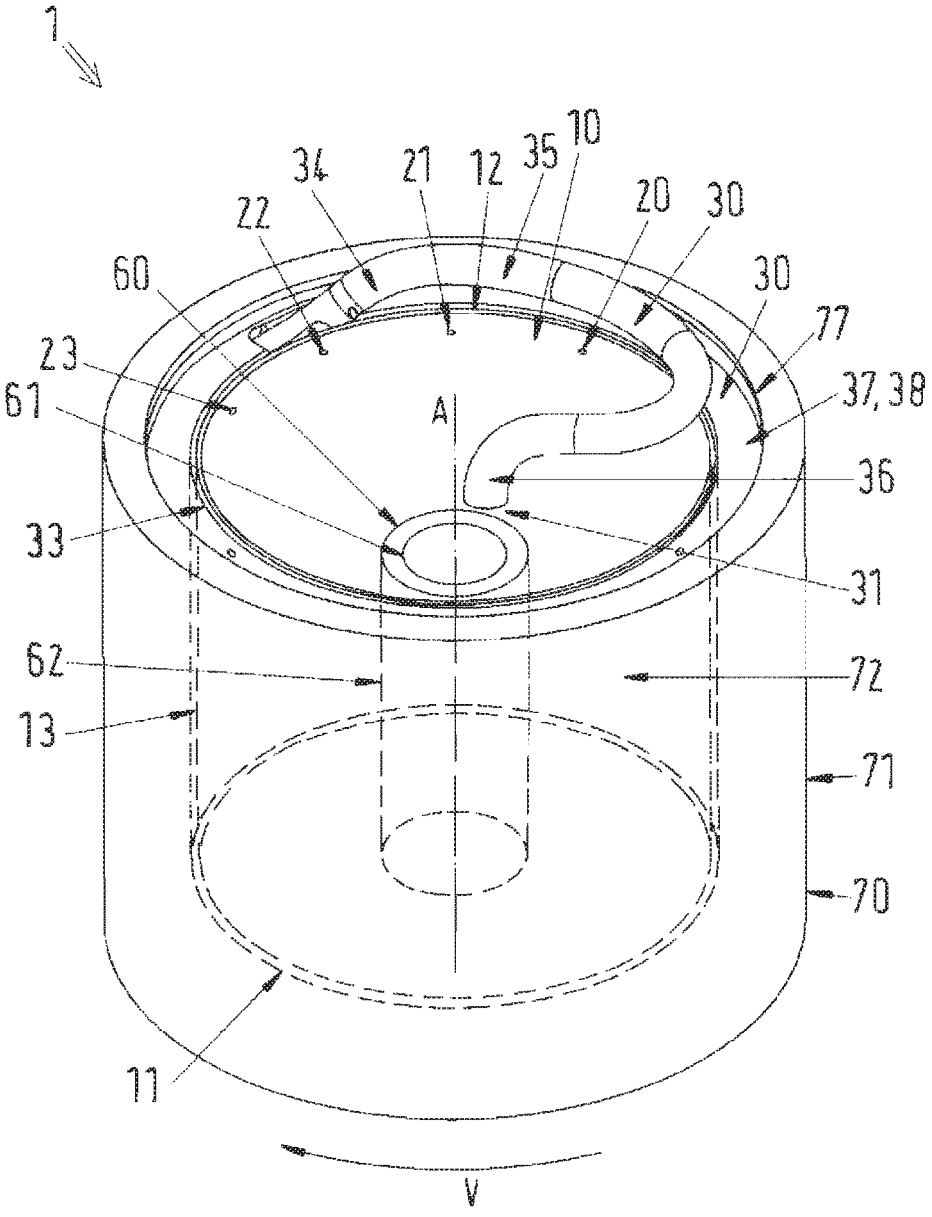
FIG. 2 shows a perspective view of a wet treatment device.

FIG. 2 shows a perspective view of a wet treatment device 1, in which, however, numerous components have been omitted from the illustration in order to clearly show the function of the recirculation line device 30.

It is possible to see an outer drum-like housing 70 which is rotationally fixed and in the form of a pressure vessel 71. A housing opening 77 on a top side can be closed off by way of a housing cover. A pressure chamber 72 is thus formed within the housing 70.

Within the housing 70, in particular within the pressure chamber 72, there is rotatably mounted a treatment drum 10, which can in particular be driven in a direction of rotation V about a vertical axis of rotation A by a rotary drive. Here, the central axis of the treatment drum 10 is arranged coaxially with respect to the axis of rotation A. The treatment drum 10 has a closed drum base 11, has a drum opening 12 on a top side, and has a drum shell 13 which is arranged circumferentially relative to the axis of rotation A and which is of substantially cylindrical form. The drum opening 12 on the top side can be closed off by way of a drum cover which has a central opening.

In the drum shell 13, it is possible to see four outlet openings 20, 21, 22, 23. These are all situated at the same (vertical) height in the direction of the axis of rotation A and are arranged so as to be evenly distributed over the circumference of the drum shell 13. It is also possible to see that each outlet opening 20, 21, 22, 23 is arranged in the upper tenth, and thus at the upper end, of the drum shell 13, and consequently also closer to the drum opening 12 than to the drum base 11.

It is possible, in the center of the treatment drum 10, to see a core drum 60 which is oriented coaxially with respect to the axis of rotation A. Said core drum has a core drum opening 61 on a top side and has a sieve-like core drum shell 62 which extends as far as the drum base 11. The core drum opening 61 has a collar at the inside. Said collar prevents rotating liquor from overflowing through the core drum opening 61. The diameter of the core drum shell 62 is considerably smaller, in this case by more than a factor of 4, than the diameter of the drum shell 13. In particular, the core drum 60 is in the form of a cylinder composed of a sieve plate which is fastened to the drum base 11 of the treatment drum 10.

The outlet openings 20, 21, 22, 23 all open into a rotationally fixedly arranged recirculation line device 30. The recirculation line device 30 likewise lies within the housing 70 and is connected rotationally fixedly and axially fixedly thereto. For the opening-in of the outlet openings 20, 21, 22, 23, the recirculation line device 30 has a ring-shaped duct 32 which radially surrounds the treatment drum 10 and which is formed so as to be open in the direction of the first outlet opening 20. Here, a minimum gap 33 remains between the treatment drum 10 and the ring-shaped duct 32.

The recirculation line device 30 is of entirely pump-free design. Its mode of operation is based on a recirculation of the liquor M by way of the rotation of the treatment drum 10, which likewise sets the liquor in rotation, whereby the latter has kinetic energy. It can be seen that the recirculation line device 30 conducts the liquor through the drum opening 12 back into the treatment drum 10. For this purpose, the ring-shaped duct 32 is adjoined by further tubular line sections, specifically firstly a riser section 34, which opens out from the ring-shaped duct 32 on the top side, subsequently a winding section 35, and finally a falling section 36, which forms the outflow opening 32.

The riser section 34 that opens out from the ring-shaped duct 32 overcomes a height difference in the longitudinal direction of the axis of rotation A between the ring-shaped duct 32 and the drum opening 12. A ramp (not visible) diverts the liquor within the ring-shaped duct 32 upward into the riser section 34. The ramp consequently at least partially circumferentially interrupts the ring-shaped duct, in particular in the region of the outer radius. The riser section 34 leads beyond the drum opening 12, such that the recirculation line device 30 can be led in the direction of the axis of rotation A from the outside across the drum wall 13. Here, the riser section 34 winds in the direction of rotation V about the axis of rotation A from the direction of the ring-shaped duct 32 in the direction of the outflow opening 31. The flow cross section of the riser section 34 amounts to between 90% and 110% of that of the ring-shaped duct 32. Furthermore, the maximum gradient of the riser section 34 is approximately 15%.

The riser section 34 is adjoined by the substantially horizontally running winding section 35. Said winding section winds in the direction of rotation V about the axis of rotation A from the direction of the ring-shaped duct 32 in the direction of the outflow opening 31, wherein said winding section approaches said axis of rotation. Here, the winding forms a tightening curve, specifically similar to a logarithmic spiral.

The winding section 35 is followed by the falling section 36, which diverts the flow direction of the liquor into the vertical, specifically substantially downward in the direction of the axis of rotation A. The falling section 36 ends at the outflow opening 31, which points downward. Thus, the outflow opening 31 is positioned above the drum base 11 and closer than the outlet openings 20, 21, 23, 24 to the axis of rotation A. In particular, the outflow opening 31 of the recirculation line device 30 is also arranged closer than the core drum shell 62 to the axis of rotation A, such that the liquor passes back into the core drum 60.

It is clear in FIG. 2 that the riser section 34, the winding section 35 and the falling section 36 transition into one another in flowing fashion, that is to say without kinks. The riser section 34 and the falling section 36 in this case each overlap with the winding section 35, such that, in the region of overlap, there is simultaneously a rising portion and approaching winding, and an approaching winding and falling portion, respectively. In this way, a high recirculation rate is achieved owing to a low flow resistance. The falling section 36 is led through the drum opening 12, and the outflow opening 31 is situated approximately at the level of the outlet openings 20, 21, 22, 23.

Furthermore, it is possible to see a heating section 37 of the recirculation line device 30. Said heating section comprises a heating duct 38 for conducting a fluid heating medium, said heating duct adjoining the ring-shaped duct 32. The heating duct 38, too, surrounds the treatment drum 10 radially in ring-shaped fashion. Here, the ring-shaped duct 32 is situated partially within the heating duct 38. Only the inner side of the ring-shaped duct 32 is exposed so as to be able to be situated opposite the drum wall 13.

It is thus now possible for textile make-ups and liquor to be introduced into the treatment drum 10 and for the treatment drum to be rotated about the axis of rotation A. By way of a resultant centrifugal force, the liquor is then accelerated from the center of the treatment drum 10 in the direction of the drum shell 13. Here, said liquor collects on the inner side of the drum shell 13 and passes from here through the outlet openings 20, 21, 23, 24 into the ring-shaped duct 32. A major part of the liquor is then, by way of the recirculation line device 30, conducted back, without the use of a drive, that is to say without an additional pump, into the treatment drum 10 again at a position closer to the axis of rotation A via the outflow opening 31.

Figure 3:
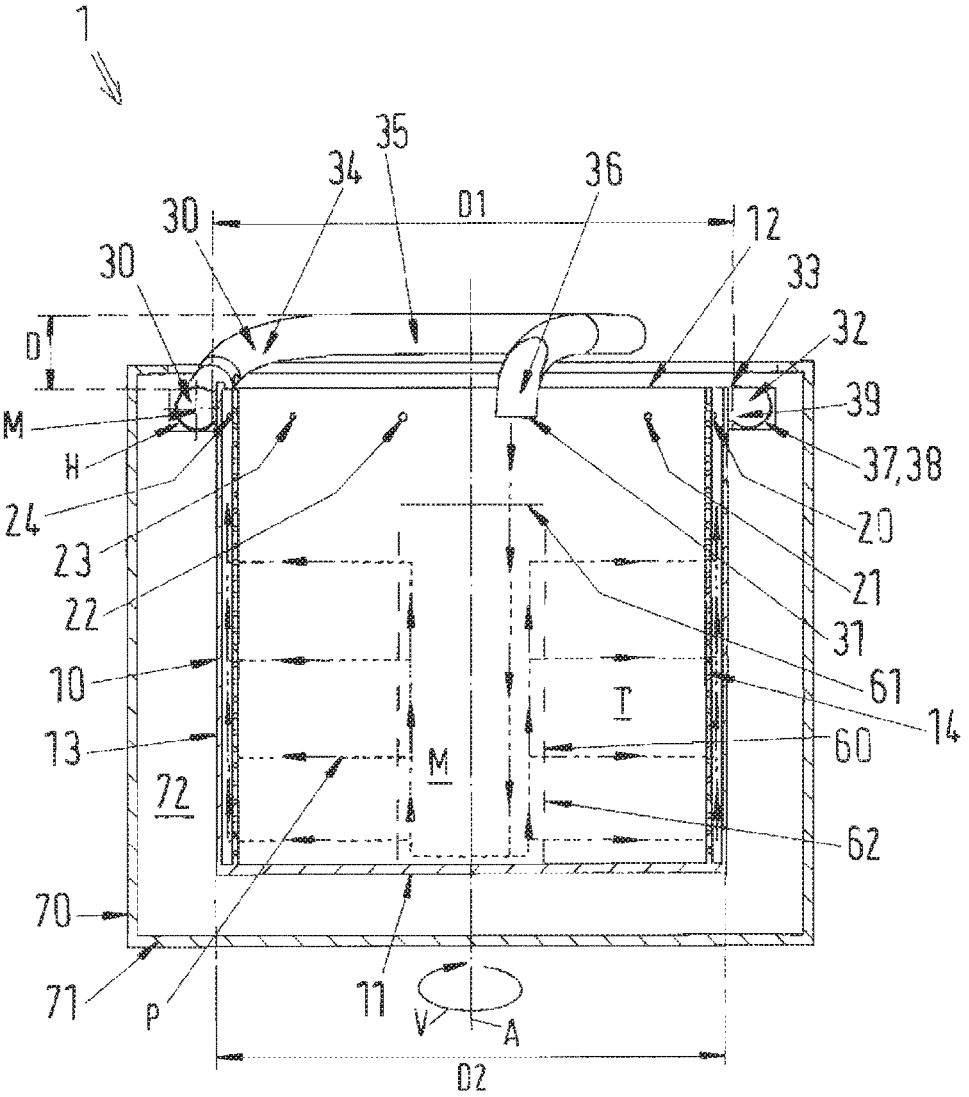
FIG. 3 shows a vertical section through a wet treatment device.

FIG. 3 shows a vertical section through the wet treatment device 1 as per FIG. 2. Only the riser section 34, winding section 35 and falling section 36 are shown in a perspective view. The features shown in FIG. 2 and described above consequently also appear in FIG. 3. A number of further details are however additionally disclosed in FIG. 3. Accordingly, it is possible to see a fifth outlet opening 24 in the drum shell 10. Also marked in FIG. 3 are the external diameter D2 of the drum shell 10, the internal diameter D1 of the ring-shaped duct 32, and the height difference D bridged by way of the riser section 34.

FIG. 3 also clearly illustrates the construction of the ring-shaped duct 32 in cross section, which is specifically substantially circular to U-shaped. In this regard, it can be seen in particular that the ring-shaped duct 32 has a ring-shaped duct slot 39 on the inner side, said ring-shaped duct slot being of slightly taller form in terms of height than the outlet openings 20, 21, 22, 23, 24, 25. The height of the ring-shaped duct 32 is however greater than the vertical extent of the ring-shaped slot 39. The latter opens into the ring-shaped duct 32 in the lower half. In the upward direction, the cross section of the ring-shaped duct 32 extends substantially up to the height of the drum opening 12. The liquor M thus flows in said ring-shaped duct 32, in particular in rotating fashion on the outer wall.

Also made clear is the design of the heating section 37, the heating duct 38 of which adjoins the ring-shaped duct 32 in L-shaped fashion, specifically on the bottom side and on the outer side. A heating medium M can be conducted through said heating duct 38.

It can be seen that a sieve wall 14 is positioned in front of the drum wall 13. It is now possible for textile make-ups T to be arranged between the core drum 60 and the sieve wall 14, which textile make-ups can be subjected to wet treatment using the liquor M. Here, the liquor M flows along the indicated flow path P, inter alia upwards in the intermediate space between drum wall 13 and sieve wall 14.

Figure 4:
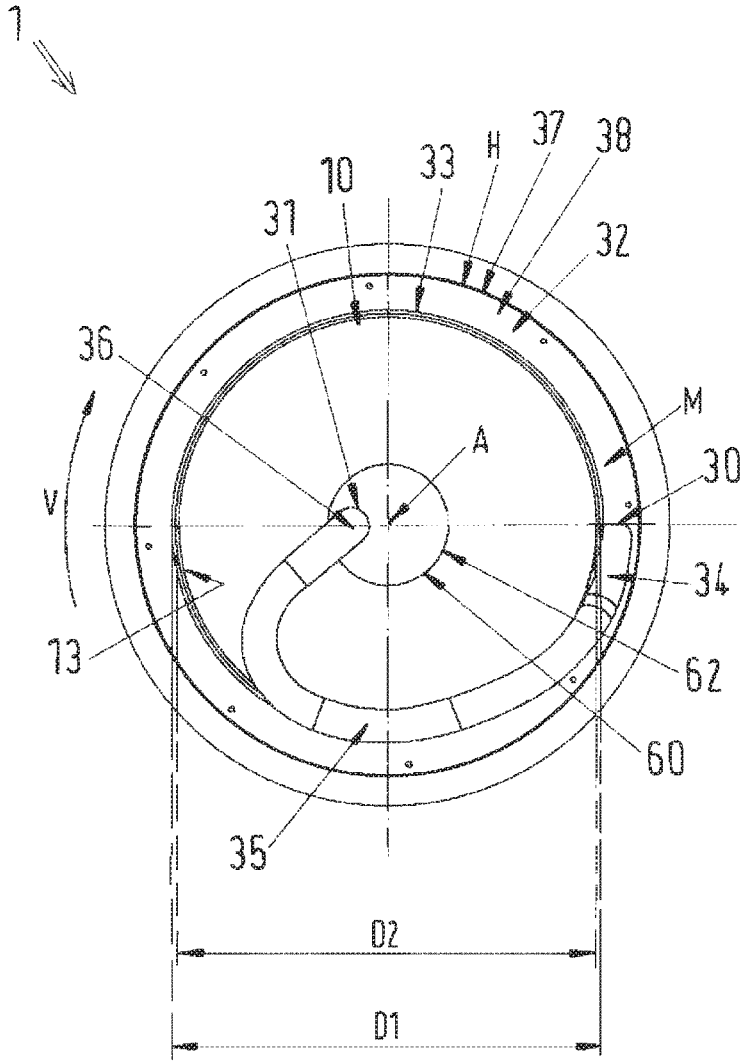
FIG. 4 shows a plan view of a wet treatment device from above.

FIG. 4 shows a plan view from above of the wet treatment device 1 shown in FIG. 2. Correspondingly, it is also the case here that many of the features shown in FIG. 2 and described above are shown and denoted in FIG. 4. As in FIG. 3, it is possible to see the internal diameter D1 of the ring-shaped duct 32, the external diameter D2 of the drum shell 13, and the minimum gap 33 situated in between. In this case, too, as in FIG. 3, liquor M flows through the ring-shaped duct 32 and heating medium H flows through the heating section 37, in particular the heating duct 38.

Figure 5:
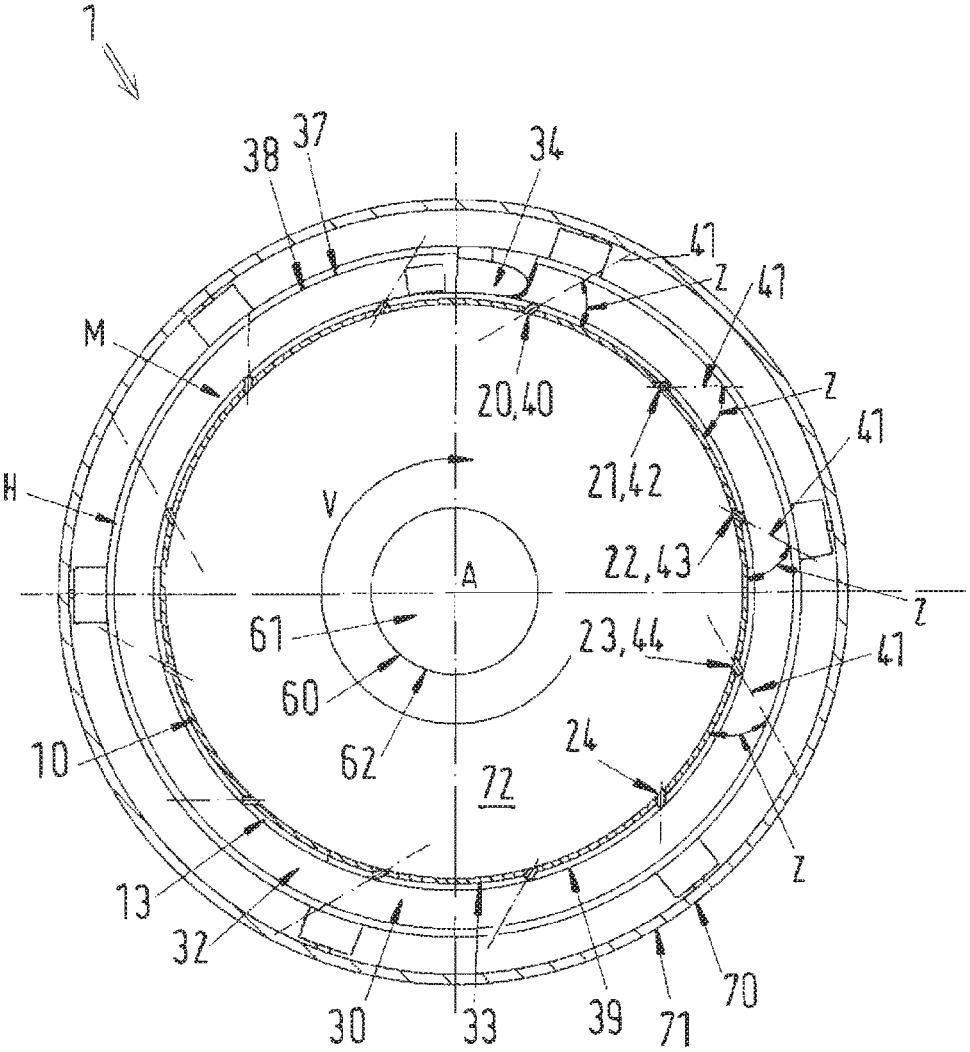
FIG. 5 shows a horizontal section through a wet treatment device in the plane of the outlet openings.

FIG. 5 shows a horizontal section through a wet treatment device 1 in the plane of the outlet openings 20, 21, 22, 23, 24, wherein the illustration substantially shows a drum shell 13 with outlet openings 20, 21, 22, 23, 24 and a ring-shaped duct 32 of the recirculation line device 10. The outlet openings 20, 21, 22, 23, 24 are in each case in the form of nozzles 40, 42, 43, 44 which are situated at the level of the ring-shaped slot 39 of the ring-shaped duct 32. A minimum gap 33 remains between the drum shell 33 and ring-shaped duct 32. The outflow direction 41 of the nozzles 40, 42, 43, 44 has in each case an angle of inclination Z in the direction of rotation V about the axis of rotation A. The angle of inclination Z is approximately 45°. Subsequently, the speed at which the liquor M emerges from the nozzles 40, 42, 43, 44 is higher than the rotational speed of the drum shell 13.

In one subsection of the ring-shaped duct 32, it is possible to see a transition to a riser section 34. As a further detail, it is possible to see a heating section 37, which is in the form of a heating duct 38. Said heating section radially surrounds the ring-shaped duct 32. A heating medium H flows through the heating duct 38.

The drum shell 13 and the ring-shaped duct 32 are surrounded by a housing 70, which is a pressure vessel 71. The housing interior is consequently a pressure chamber 72. Also situated in the center of the treatment drum 10 is a core drum 60, of which a core drum shell 62 and a core drum opening 61 are visible.

Figure 6:
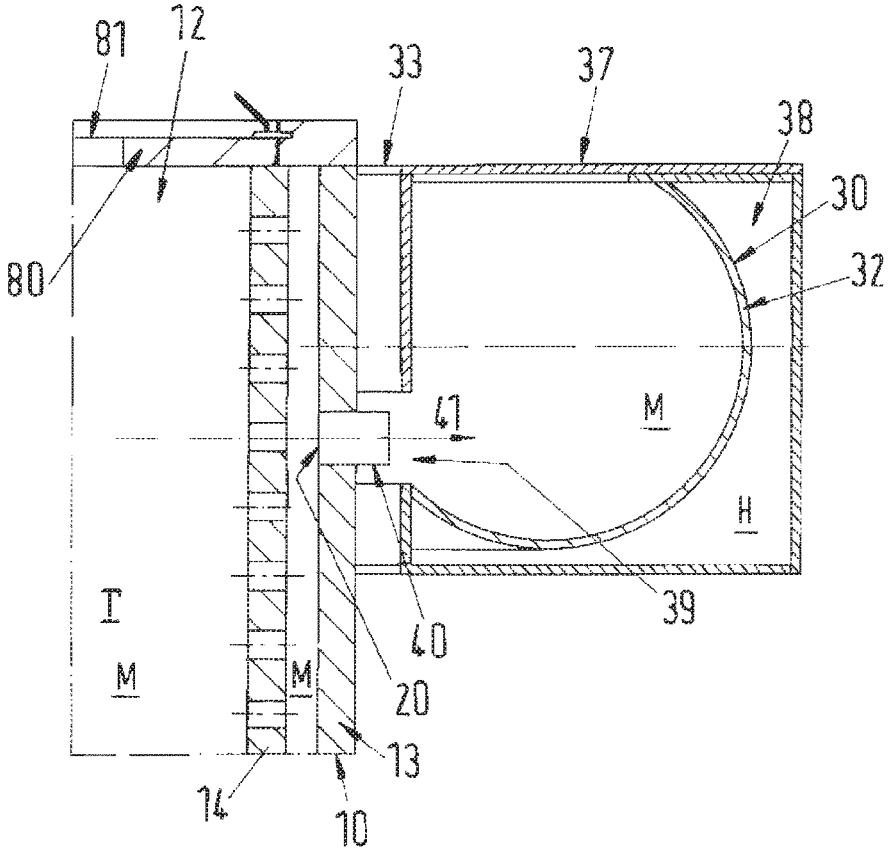
FIG. 6 shows a partial detail of a vertical section through a wet treatment device, illustrating the ring-shaped duct with heating device and the adjoining upper end of the drum shell.

FIG. 6 shows a partial detail of a vertical section through a wet treatment device 1. Said detail illustrates, on an enlarged scale, recirculation line device 30 with a ring-shaped duct 32 and with a heating section 37, and the adjoining upper end of a drum shell 13. Further details are additionally disclosed.

Here, an outlet opening 20 in the drum shell 13 is in the form of a nozzle 40. Said nozzle has an outflow direction 41. Furthermore, said nozzle projects in the direction of a ring-shaped slot 39 of the ring-shaped duct 32 which radially surrounds the drum shell 13. The nozzle 40 is a small tube inserted into the drum shell 13. For assembly purposes, the ring-shaped duct 32 may be of two-part form (composed for example of an upper and lower ring or of two ring sections), in particular if the nozzle 40 is to project as far as into the ring-shaped duct 32.

Furthermore, a sieve wall 14 is positioned in front of the drum shell 13 with a spacing. Said sieve wall retains textile make-ups T that are forced in an outward direction, and permits unhindered vertical flows of the liquor M in the intermediate region that remains with respect to the drum shell 13, in order that said liquor can pass to the outlet opening 20. At the top side, the sieve wall 14 is designed to be sealed with respect to the drum wall 13, in this case in particular by way of a fixedly connected, for example welded, ring. Alternatively, a sealing closure may also be provided at the upper edge of the sieve wall 14 by way of the drum cover 80 described below.

Specifically, the drum opening 12 of the treatment drum 10 is closed off on the top side by way of a drum cover 80, in particular in fluid-tight fashion in the zone between drum shell 13 and drum cover 80. The drum cover 80 however has a central cover opening 81. The falling section of the recirculation line device 30 can be led through said cover opening.

Figure 7:
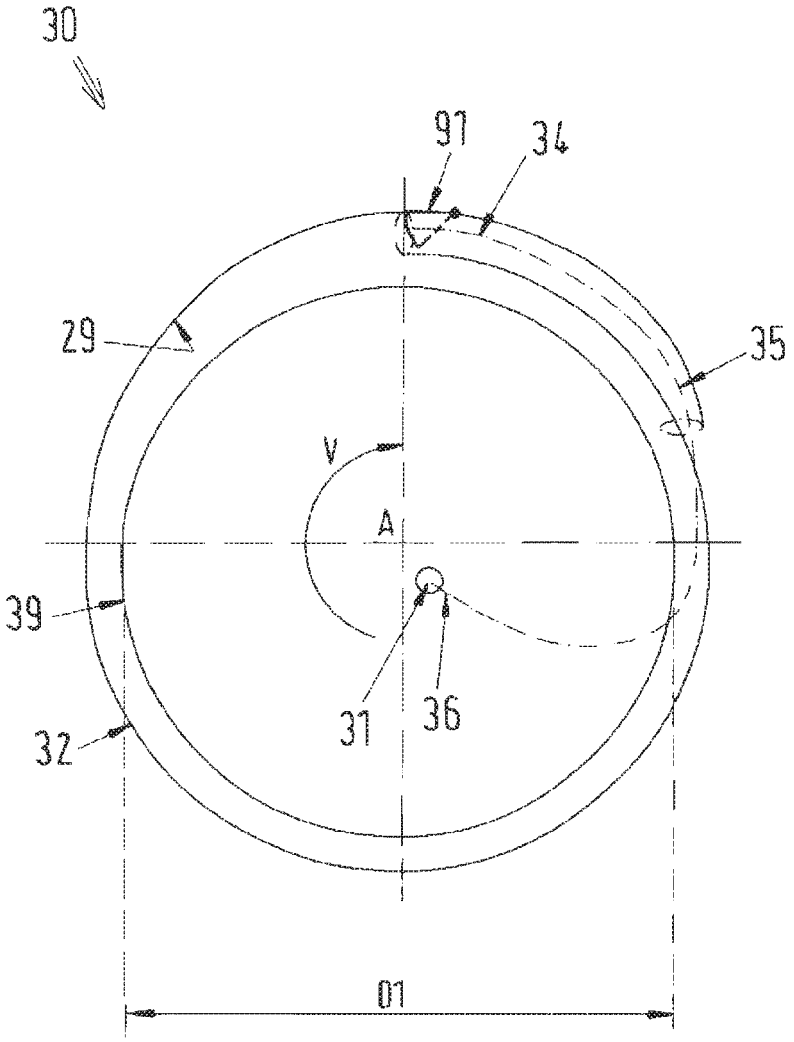
FIG. 7 shows a plan view of a schematically sketched recirculation line device.

FIG. 7 shows, in a plan view, a schematically sketched recirculation line device 30, in particular in the plane of an internally situated ring-shaped slot 39 of a ring-shaped duct 32. In the center, the axis of rotation A and a direction of rotation V of a treatment drum (not illustrated) are indicated. The ring-shaped duct 32 has a circular internal diameter D1. The spacing of the base 29 of the ring-shaped duct 32 from the internal diameter D1 increases in the direction of rotation V. After one full rotation about the axis of rotation A, that is to say after approximately 360 degrees, the base 29 adjoins a tubular line section of the recirculation line device 30, in particular a riser section 34. Said riser section is adjoined, in the direction of rotation V, firstly by a winding section 35 and subsequently by a falling section 36. The latter ends at an outflow opening 31 in the center of the ring-shaped duct 32, in particular between the ring-shaped slot 39 and the axis of rotation A. The winding section 35 and the falling section 36 lead out of the illustrated plane, for which reason the profile thereof is, in sections, merely indicated by a dashed line.

An advantage of such a design is that the ring-shaped slot 39 can extend of the entire circumference, and only a small amount of liquor does not pass into the riser section 34 as a result of foaming and spraying.

In different variants, with a constant spacing between the base 39 and the internal diameter D1, the advantage lies in particular in the fact that a surrounding housing needs only to have a particularly small internal diameter, which offers cost advantages in particular in the case of the housing being designed as a pressure vessel.

Furthermore, at the transition between base 29 and riser section 34, it is possible to see an openable outlet opening 91, which would consequently be arranged radially outside a treatment drum. The outlet opening 91 is in particular closed off by a flap. Said flap can be opened inwardly, as indicated. In this way, said flap at least partially shuts off the riser section 34 when in the open position. The liquor can thus be drained particularly quickly.

All of the described directions, such as vertical, horizontal, upward and downward, are to be understood as geodetic orientations when the wet treatment device is in an operating position.

The invention is not restricted to the embodiments described above, but rather may be modified in a variety of ways.

Accordingly, an embodiment is also conceivable in which the line sections of the recirculation line device do not lead beyond the drum opening and issue into the treatment drum from above. Instead, it is also possible for a falling section to be provided, which is adjoined by a riser line through the drum base. For this purpose, the riser line should be arranged coaxially with respect to the axis of rotation and should be sealed off with respect to the drum base. In this way, the kinetic energy of the liquor, and the gradient, can be utilized for the recirculation action. However, the arrangement of the riser line through the drum base is slightly more complex and more expensive, and normally cannot be retrofitted to existing devices.

Furthermore, the invention is not restricted to a single line section adjoining the ring-shaped duct. It is also possible for at least two line sections to be arranged so as to be distributed over the circumference.

All of the features and advantages that emerge from the claims, from the description and from the drawing, including structural details, spatial arrangements and method steps, may be essential to the invention both individually and in a wide variety of combinations.

LIST OF REFERENCE DESIGNATIONS

1 Wet treatment device
10 Treatment drum
11 Drum base
12 Drum opening
13 Drum shell
14 Sieve wall
20 First outlet opening
21 Second outlet opening
22 Further outlet opening
23 Further outlet opening
24 Further outlet opening
29 Base
30 Recirculation line device
31 Outflow opening
32 Ring-shaped duct
33 Minimum gap
34 Riser section
35 Winding section
36 Falling section
37 Heating section
38 Heating duct
39 Ring-shaped duct slot
40 Nozzle
41 Outflow direction
42 Nozzle
43 Nozzle
44 Nozzle
60 Core drum
61 Core drum opening
62 Core drum shell
70 Housing
71 Pressure vessel
72 Pressure chamber
73 Housing cover
74 Housing cover leadthrough
75 Housing base
76 Discharge pipe
77 Housing opening
80 Drum cover
81 Central opening
90 Rotary drive
A Axis of rotation D Height difference
D1 Internal diameter (ring-shaped duct)
D2 External diameter (treatment drum)
H Heating medium
I Internal pressure
M Liquor (treatment agent)
P Flow path
T Textile make-up
V Direction of rotation
Z Angle of inclination

The invention claimed is:

1. A wet treatment device for the wet treatment of textile make-ups, having a treatment drum which is driven in a direction of rotation about a vertical axis of rotation by a rotary drive, wherein the treatment drum has a closed drum base, a drum opening on a top side, and a drum shell which is arranged at the circumference relative to the axis of rotation and which has at least one first outlet opening, characterized in that the first outlet opening issues into a rotationally fixedly arranged recirculation line device, wherein the recirculation line device has a ring-shaped duct which radially encompasses the treatment drum and which is formed so as to be open in the direction of the first outlet opening, wherein an opening of the ring-shaped duct that opens in the direction towards the first outlet opening of the drum shell is in the form of an encircling slot at a radially inner side of the ring-shaped duct, wherein the encircling slot opens in the direction of the drum shell and encircles the drum shell, and wherein the recirculation line device has an outflow opening which is positioned above the drum base and closer than the first outlet opening to the axis of rotation, wherein the drum shell is configured to rotate with respect to the encircling slot of the recirculation line device.

2. The wet treatment device as claimed in claim 1, characterized in that at least one second outlet opening is formed in the drum shell, wherein each outlet opening issues into the ring-shaped duct of the recirculation line device.

3. The wet treatment device as claimed in claim 2, characterized in that each outlet opening is in the form of a nozzle, wherein the outflow direction of the nozzle has an angle of inclination in the direction of rotation.

4. The wet treatment device as claimed in claim 3, characterized in that the angle of inclination is between 40° and 50°.

5. The wet treatment device as claimed in claim 2, characterized in that each of the at least one first outlet opening that is formed in the drum shell is arranged in the upper third of the drum shell.

6. The wet treatment device as claimed in claim 5, wherein the encircling slot is arranged in the upper third of the drum shell.

7. The wet treatment device as claimed in claim 1, characterized in that the recirculation line device has a riser section which bridges a height difference in the longitudinal direction of the axis of rotation between the ring-shaped duct and the drum opening and which leads beyond the drum opening.

8. The wet treatment device as claimed in claim 7, characterized in that the riser section winds in the direction of rotation about the axis of rotation from the direction of the ring-shaped duct in a direction of the outflow opening.

9. The wet treatment device as claimed in claim 1, characterized in that the recirculation line device has a winding section which winds around the axis of rotation and which, from a direction of the ring-shaped duct, approaches the axis of rotation in a direction of the outflow opening and in the direction of rotation.

10. The wet treatment device as claimed in claim 1, characterized in that the recirculation line device has a falling section which adjoins the outflow opening and which falls substantially vertically.

11. The wet treatment device as claimed in claim 1, characterized in that, in the treatment drum, there is arranged a core drum which is oriented coaxially with respect to the axis of rotation and which has a core drum opening on a top side and which has a sieve-like core drum shell and which extends as far as the drum base.

12. The wet treatment device as claimed in claim 11, characterized in that the outflow opening of the recirculation line device is arranged closer than the core drum shell to the axis of rotation.

13. The wet treatment device as claimed in claim 1, characterized in that the recirculation line device has a heating section.

14. The wet treatment device as claimed in claim 1, characterized in that the recirculation line device has an openable outlet opening radially outside the treatment drum.

15. The wet treatment device as claimed in claim 1, characterized in that the treatment drum and the recirculation line device are arranged within a housing which collects discharged liquor.

16. The wet treatment device as claimed in claim 15, wherein the housing is in the form of a pressure vessel with a pressure chamber, and the treatment drum is arranged within the pressure chamber.

17. The wet treatment device as claimed in claim 16, characterized in that the pressure vessel withstands an internal pressure in the pressure chamber of at least 1.5 bar.

18. A method for operating a wet treatment device as claimed in claim 1, characterized by the following steps:

introducing a textile make-up into the treatment drum;

introducing a liquor into the treatment drum;

rotating the treatment drum in the direction of rotation, wherein, owing to a resultant centrifugal force, the liquor is accelerated from the center of the treatment drum in the direction of the drum shell, flows through the first outlet opening into the ring-shaped duct of the recirculation line device, and, by way of the recirculation line device, is at least partially recirculated, without the use of a drive, into the treatment drum again at a position closer to the axis of rotation via the outflow opening of the recirculation line device.

19. The wet treatment device as claimed in claim 1, wherein the first outlet opening is in the form of a nozzle configured to extend into the encircling slot.

20. The wet treatment device as claimed in claim 1, wherein the first outlet opening is configured to face the encircling slot.

21. The wet treatment device as claimed in claim 1, wherein a height of the opening of the ring-shaped duct that is in the form of the encircling slot is greater than a height of the first outlet opening.

22. The wet treatment device as claimed in claim 1, wherein the recirculation line device is of a pump-free design.

* * * * *